United States Patent [19]

Vogel

[11] Patent Number: 5,023,963

[45] Date of Patent: Jun. 18, 1991

[54] SELF ADJUSTING AND SELF SECURING SHAMPOO TRAY

[76] Inventor: Naomi R. Vogel, 2105 Berrywood La., Bloomington, Ill. 61704

[21] Appl. No.: 541,723

[22] Filed: Jun. 21, 1990

[51] Int. Cl.[5] ..... A45D 44/08

[52] U.S. Cl. ..... 4/521

[58] Field of Search ..... 4/515, 519, 520, 521, 4/522, 523; 224/148

[56] References Cited

U.S. PATENT DOCUMENTS

| | | | |
|---|---|---|---|
| 748,081 | 12/1903 | Larrimore | 4/520 |
| 1,429,950 | 9/1922 | Jones et al. | 4/515 |
| 1,617,537 | 2/1927 | Morin | 4/520 |
| 1,977,769 | 10/1934 | Levy | 4/520 |
| 2,013,823 | 9/1935 | Chancer | 4/520 |
| 2,087,843 | 7/1937 | Goodrich | 4/521 |
| 2,112,669 | 3/1938 | Halas | 4/522 X |
| 2,163,755 | 6/1939 | Labruzzo | 4/520 |
| 2,212,016 | 8/1940 | Ellis | 4/520 |
| 2,301,486 | 11/1942 | Weilerstein | 4/521 |
| 2,357,461 | 9/1944 | Ellinger | 4/521 |
| 2,375,643 | 5/1945 | Germanotta | 224/148 X |
| 2,451,652 | 10/1948 | Bazelon | 4/520 |
| 2,451,653 | 10/1948 | Bazelon | 248/205.6 |
| 2,501,829 | 3/1950 | Rugh | 4/520 |
| 2,516,601 | 7/1950 | Smalls | 4/520 |
| 2,599,217 | 6/1952 | Artman | 4/520 |
| 2,954,077 | 9/1960 | Wanner | 4/522 |
| 3,100,898 | 8/1963 | Wade | 4/515 |
| 3,731,325 | 5/1973 | Guarrasi | 4/519 |
| 3,973,279 | 8/1976 | Giffen | 4/520 X |
| 4,014,054 | 3/1977 | Pasquarello | 4/521 |
| 4,216,551 | 8/1980 | Pasquarello | 4/521 |
| 4,901,378 | 2/1990 | Reddell | 4/515 |

FOREIGN PATENT DOCUMENTS

| | | | |
|---|---|---|---|
| 205368 | 6/1939 | Switzerland | 4/420 |

*Primary Examiner*—Henry J. Recla
*Assistant Examiner*—Robert M. Fetsuga
*Attorney, Agent, or Firm*—Wood, Phillips, Mason, Recktenwald & VanSanten

[57] ABSTRACT

A self adjusting and self securing shampoo tray for accommodating recipients of varying heights sitting in an upright position without the need of fastening or strapping the shampoo tray to the recipients or a runoff receiving basin comprises a rigid body divided into first and second sections by a hinge allowing the free end of the first section which contains an arcuate neck receiving opening swing with respect to the second section. Attached to the bottom of the first section are shoulder supports being of greatest height proximate to the neck receiving opening and of decreasing height as they extend therefrom such that the height and slope of the supports is sufficient to maintain the neck receiving opening against a recipient's neck while directing runoff flow towards the second section and into a receiving basin regardless of the height of the recipient.

12 Claims, 1 Drawing Sheet

SELF ADJUSTING AND SELF SECURING SHAMPOO TRAY

BACKGROUND OF THE INVENTION

1. Technical Field

The present invention is directed towards shampoo trays, and more particularly towards a laterally floating self adjusting and self securing shampoo tray.

2. Background Art

Shampoo trays for directing shampoo run-off away from a reclined recipient and into a receiving basin are generally known in the art. Such trays generally involve a rigid body with a neck receiving opening in one end and a means securing the body to a receiving basin attached to the end of the body opposite the neck receiving opening. The securing means allows a recipient in a reclined position to forcibly rest her neck against the neck receiving opening and thereby prevent the flow of runoff between her neck and the neck receiving opening.

Other shampoo trays known in the art are similar in structure to those discussed above, only the means securing the shampoo tray is disposed between the end of the body having the neck receiving opening and the end of the body opposite the neck receiving opening discharging the shampoo run-off. These trays function in a similar manner: when in a reclined position the recipient's neck forcibly rests against the neck receiving opening to provide a seal for preventing the shampoo run-off from running therebetween.

Other prior art shampoo trays do not involve a means for securing the shampoo tray to the run-off receiving basin and do not require the recipient to recline against the neck receiving opening. These trays generally comprise a body with a neck receiving opening at one end and a second end for discharging shampoo run-off. Among the various shampoo trays of this type are those in which the neck receiving opening is secured about the neck by straps engaging the recipient's head, neck or shoulders.

While the above described shampoo trays recognize the need for a shampoo tray usable with recipients of varying heights, they have numerous serious shortcomings. Those requiring a means for securing the tray to the receiving basin are difficult and expensive to manufacture. In addition, many are suitable only for receiving basins having a particular rim structure. All such trays require the basin to be firmly secured. Moreover, they are difficult to use, often requiring time consuming adjustments to properly fit recipients of varying heights. Finally, the trays require the recipient to be in a reclined position, making them unsuitable for recipients in wheelchairs or who are otherwise unable to recline against the neck receiving opening.

Those shampoo trays having straps for maintaining the tray against the recipient's neck have similar serious deficiencies. First, these trays are not suitable for recipients with neck and head injuries who may be injured or discomforted by the securing of the straps about their head, neck or shoulders. Second, these devices are expensive and difficult to manufacture because the straps must be attached to the shampoo tray body. Lastly, these shampoo trays are difficult to use because they require adjustment when being fastened to the recipient.

The present invention is directed toward overcoming one or more of the problems discussed above.

SUMMARY OF THE INVENTION

Accordingly, it is an object of the invention to provide a shampoo tray which may be used when a recipient is in an upright seated position.

It is a further object of the invention to provide a shampoo tray which may be used with recipients of varying heights while still directing the run-off flow to a basin.

It is still a further object of the invention to provide a shampoo tray that does not require being strapped or otherwise fastened to a recipient.

It is yet another object of the invention to provide a shampoo tray that can be inexpensively manufactured in a single operation.

In one aspect of the present invention a shampoo tray is provided for catching and discharging the run-off from shampoo operations of recipients of varying heights into a basin while the recipients may be seated in an upright position. The shampoo tray comprises a rigid body having a run-off containing and directing first and second sections. A hinge joins the first and second sections allowing the free end of the first section to swing laterally for accommodating recipients of varying heights. The first section has an arcuate neck receiving opening formed integrally therein in its free end, and opposing channels are disposed on each side of the neck receiving opening. Wi&h this arrangement, a supporting means is associated with the bottom of the first section proximate to each opposing channel for supporting the shampoo tray on the shoulders of a recipient in a manner for directing run-off flow towards the second section in a shampoo operation regardless of the height of the recipient.

In another aspect of the present invention the rigid body, the hinge and the supporting means are integrally formed in a single manufacturing operation.

In another aspect of the present invention the supporting means comprises elongated shoulder supports extending from proximate to the neck receiving opening to away from the neck receiving opening generally perpendicular to the hinge. The shoulder supports are of greatest height proximate to the neck receiving portion and of decreasing height as they extend therefrom toward the hinge. The height and downward slope of the shoulder supports are sufficient to maintain the neck receiving opening against a recipient's neck while directing run-off flow towards the second section in a shampoo operation regardless of the height of the recipient.

In another aspect of the present invention the shampoo tray comprises a rigid body having a runoff directing top and a neck receiving end and a runoff discharging end. The neck receiving end has an arcuate neck receiving opening formed integrally therein and the rigid body has opposing channels disposed on either side of the neck receiving opening. A shoulder support is associated with the bottom of the body proximate to each channel and the shoulder supports comprise elongated platforms each having a first and second end extending generally parallel to the receiving channels. The first ends of the platforms are proximate to the neck receiving opening and of a height greater than that of the second ends of the platforms. Further, the platforms are of decreasing height as they extend away from the neck receiving opening toward the second ends thereof. Preferably, the height and downward slope of the platform are sufficient to maintain the neck receiving opening against a recipient's neck while directing run-off flow towards the discharging end of the body in a shampoo operation regardless of the height of the recipient.

Still other aspects, objects and advantages of the present invention can be obtained from a study of the specification, the drawings and the appended claims.

DETAILED DESCRIPTION OF THE PREFERRED EMBODIMENTS

Figure 1:
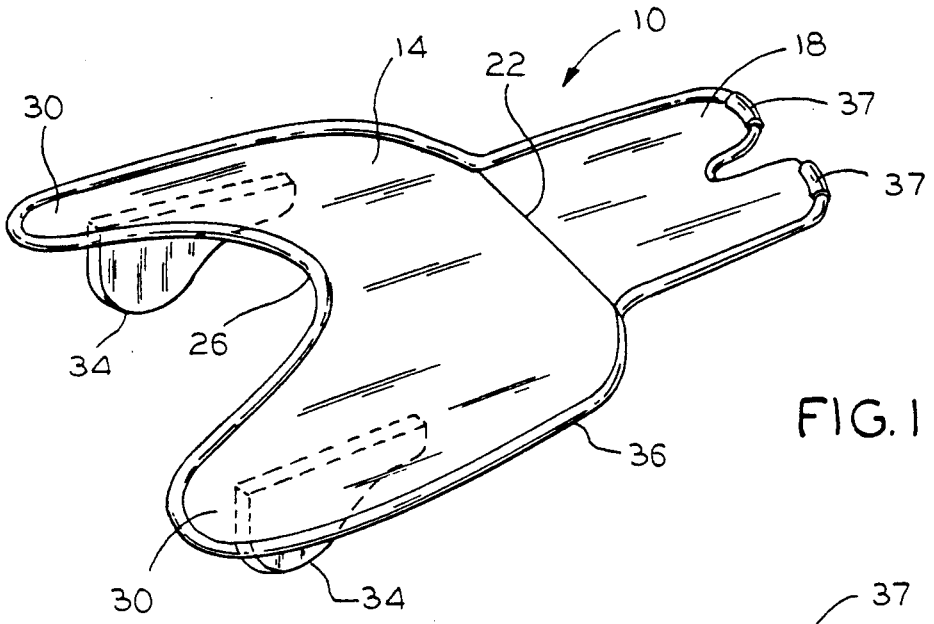
FIG. 1 is a perspective view of a laterally adjusting self securing shampoo tray in accordance with the present invention.

With reference to FIG. 1, a body 10 is formed from a first section 14 and a second section 18 joined by a hinge 22 therebetween. The first section 14 contains an arcuate neck receiving opening 26 opposite its joined end and opposing channels 30 are disposed on each side of the neck receiving opening 26. Still referring to FIG. 1, the body 10 further includes a shoulder support 34 disposed proximate to the underside of each channel 30.

The body 10 may be formed of any pliant material capable of containing water. By way of example, and not limitation, a vinyl plastic has been found to yield acceptable results. The body 10 so formed comprises a unique laterally adjusting self securing shampoo tray.

Figure 3:
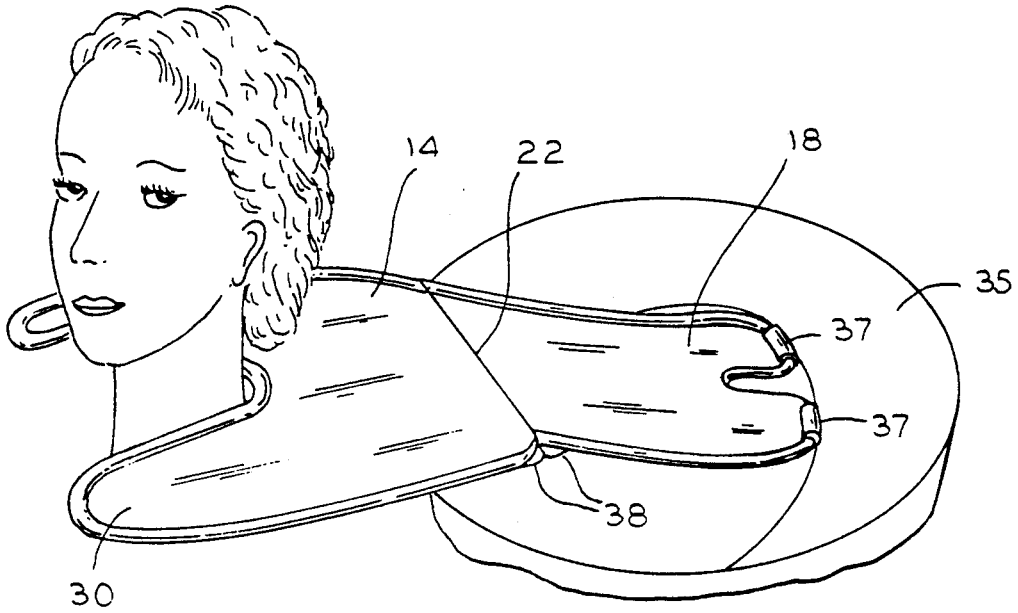
FIG. 3 is a perspective view illustrating use of the laterally adjusting self securing shampoo tray of FIG. 1.

The first section 14 may generally be of any length, but preferably it is of length sufficient to reach the edge of a basin 35 (as illustrated in FIG. 3) in situations when the recipient must be seated away from the basin 35. For example, when the recipient is seated in a wheel chair and the wheels or handles do not allow the wheel chair to be backed closely to the basin 35. A length of between 18 and 22 inches yields acceptable results.

The second section 18 may generally be of any length, but preferably it is of a length sufficient to reach from the bottom rear portion to the front top portion of various sized receiving basins. A length of between 15 and 17 inches yields acceptable results.

With the continued reference to FIG. 1, in the preferred embodiment, a rim 36 surrounds the periphery of the body 10. The rim 36 is preferably formed integral with the body 10. Alternatively, the rim 36 may be added to the body 10 in a separate manufacturing process.

Preferably the hinge 22 is a living hinge, i.e., formed integral to the body 10, as by having a weakening crease between the first and second sections 14 and 18. However, the first body section 14 and the second body section 18 may be joined by at least one separately formed hinge.

When the second section 18 is disposed within a receiving basin 35 as illustrated in FIG. 3, the hinge 22 allows the first section 14 to swing laterally to accommodate shampooing recipients of varying heights while the second section 18 acts to stabilize the shampoo tray by resting against the back edge of the bottom of the receiving basin 35. Rounded bumpers 37 conformable to the curved edges of the receiving basin 35 are preferably formed integrally with the water discharging end of the second section 18.

Figure 2:
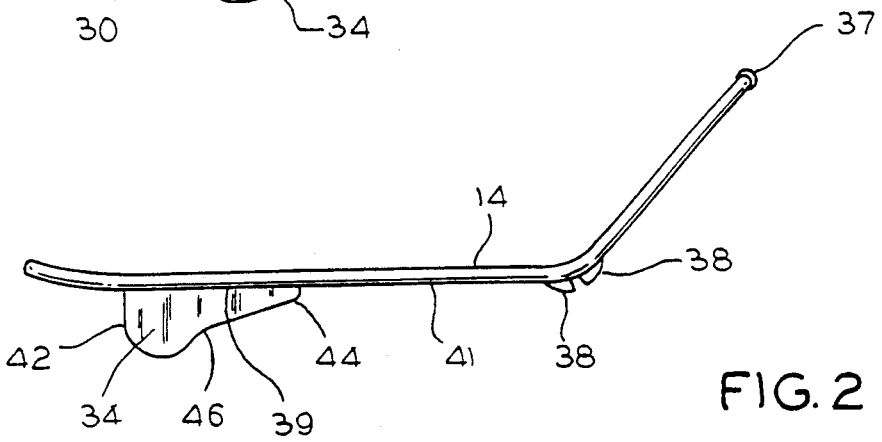
FIG. 2 is a side view further illustrating the laterally adjusting self securing shampoo tray of FIG. 1.

Referring now to FIG. 2, with either hinge structure a stop 38 is provided to prevent the bottom surfaces of the first and second sections 14 and 18 from folding together. Preferably the stop 38 is formed integral with the body 10 and hinge 22. For ease in transporting and storing the shampoo tray, the top sides of the first section 14 and the second section 18 may be folded together in the opposite direction about the hinge 22.

Referring again to FIG. 2, it will be seen that the top edge 39 of the shoulder support 34 is joined to the bottom surface 41 of the first section 14. The shoulder support 34 comprising what may be considered an elongated platform will suitably be of a configuration that elevates the first section 14 of the body 10 above the shoulders of a recipient to direct run-off flow towards the second section 18 in a shampoo operation. Preferably the leading edge 42 of the shoulder support 34 is of a height greater than the trailing edge 44.

In practice, a 2.25 inch height differential between the leading edge 4 and the trailing edge 44 has been found to yield the best results, although other height differentials may be acceptable. However, the principal criteria is that the trailing edge 44 should be of some height less than the leading edge 42. As for the bottom surface 46 of the shoulder support 34, it preferably extends between the leading edge 42 and the trailing edge 44 in a generally arcuate manner.

In the preferred embodiment, the shoulder support 34 is formed integral with the bottom surface 41 of the first section 14. However, it may be desirable in some instances for the shoulder support 34 to be formed separately so as to be detachable or adjustable.

In an alternate embodiment the body 10 may comprise a single section without a hinge. As will be appreciated the structure will otherwise be identical to the above described embodiment.

Preferably the body 10, the hinge 22, the shoulder support 34, the rim 36, the bumper 37 and the stop 38 are all integrally formed in a single manufacturing operation.

When either the preferred or alternate embodiment are used as illustrated in FIG. 3, the bottom surface 46 of the shoulder support 34 will rest upon the shoulders of a recipient. The bottom surface 46 of the shoulder support 34 causes the weight of the first section 14 to be directed in part towards the back of the recipient's neck to form a seal between the neck of the recipient and the arcuate neck receiving opening 26 without requiring the recipient to recline into the neck receiving opening 26 and without requiring the shampoo tray to be strapped or otherwise fastened to the recipient. In addition, the shoulder support 34 elevates the first section 14 of the body 10 so that a recipient's shoulders may actually be of a height less than the edge of the receiving basin and the shampooing tray will still direct run-off away from the neck receiving opening 26. The rim 36 then acts to contain the water allowing it to flow over the hinge 22 and into the second section 18 of the body 10 for discharge into the receiving basin 35. The rounded bumpers 39 help stabilize the second section 18 against the back edge of the bottom of the receiving basin 35.

The present invention permits a shampoo tray for directing run-off away from a recipient to be fit against the neck of the recipient solely by reason of its construction. It permits this to occur while the recipient is sitting in an upright position and without requiring straps to attach the shampoo tray to the recipient or requiring the recipient to recline against the neck receiving opening of the shampoo tray by taking advantage of the laterally floating self adjusting and self securing nature of the device. Finally, the shampoo tray is easy to use, inexpensive to build, and requires no time consuming adjustments to engage the arcuate neck receiving opening with a recipient's neck.

While in the foregoing there has been set forth a preferred embodiment of the invention, it will be appreciated that the details herein given may be varied by those skilled in the art without departing from the true scope of the appended claims.

I claim:

1. A self adjusting and self securing shampoo tray for catching and discharging into a basin the run-off from shampoo operations of recipients of varying heights while the recipients may be seated in an upright position comprising:

a rigid body having run-off containing and directing first and second sections, the first section of the rigid body having a top and a bottom;

a hinge joining the first and second sections in a manner allowing the first section to swing relative to the second section for accommodating recipients of varying heights;

the first section having a free end opposite the hinge with an arcuate neck receiving opening formed integrally therein and defining opposing channels disposed on each side of the neck receiving opening;

the second section having a free end opposite the hinge, the first and second sections together being of a length such that the free end of the second section will engage an inner surface of the basin to support the tray between the recipient and the basin; and supporting means depending from the bottom of the first section of the rigid body proximate to each opposing channel for engaging the shoulders of a recipient to support the first section in a manner directing run-off flow towards the second section of the rigid body during a shampoo operation substantially independent of the recipient's height.

2. The self adjusting and self securing shampoo tray of claim 1 wherein the top of the first section of the rigid body has a rim defining a run-off containing periphery adapted to channel run-off to the second section of the rigid body for discharge into a basin during a shampoo operation.

3. The self adjusting and self securing shampoo tray of claim 1 wherein the hinge is a living hinge integrally formed in the rigid body.

4. The self adjusting and self securing shampoo tray of claim 1 wherein the supporting means comprises a pair of elongated supports each depending from respective ends of the opposing channels and extending toward and generally perpendicular to the hinge, the supports being of greatest height proximate to the free end of the first section and of decreasing height as they extend toward the hinge, the height and slope of the supports being sufficient to maintain the neck receiving opening against a recipient's neck while directing run-off flow towards the second section of the rigid body during a shampooing operation substantially independent of the recipient's height.

5. The self adjusting and self securing shampoo tray of claim 1 wherein the rigid body, the hinge and the supporting means are integrally formed.

6. The self adjusting and self securing shampoo tray of claim 4 wherein the rigid body, the hinge and the supports are integrally formed.

7. The self adjusting and self securing shampoo tray of claim 4 wherein the supports slope in a generally arcuate manner.

8. A self adjusting and self supporting shampoo tray for catching and discharging into a basin the run-off from shampoo operations of recipients of varying heights while the recipients may be seated in an upright position comprising:

a rigid body having a run-off containing and directing top and a bottom and a neck receiving end and a run-off discharging end;

the neck receiving end having an arcuate neck receiving opening formed integrally therein and defining opposing channels disposed on each side of the neck receiving opening;

the rigid body being of a length such that the discharging end will engage an inner surface of the basin to support the tray between the recipient and the basin; and a pair of elongated supports each depending from the bottom of a respective one of the channels and having a first and a second end and extending generally parallel to the channels, the first ends of the supports being proximate the neck receiving end and of greater height than the second ends thereof, the supports sloping downwardly from the second end to the first end sufficiently to maintain the neck receiving opening against a recipient's neck while directing run-off flow towards the discharging end of the body during a shampooing operation substantially independent of the recipient's height.

9. The self adjusting and self supporting shampoo tray of claim 8 wherein the supports means slope downwardly in a generally arcuate manner.

10. A self adjusting and self securing shampoo tray for catching and discharging into a basin the run-off from shampoo operations of recipients of varying heights while the recipients may be seated in an upright position comprising:

a rigid body having run-off containing and directing first and second sections, the first section of the rigid body having a top and a bottom and a rim on its top defining a run-off containing periphery adapted to channel run-off to the second section of the rigid body for discharge into a basin during a shampoo operation;

a hinge joining the first and second sections in a manner allowing the first section to swing relative to the second section for accommodating recipients of varying heights;

the first section having a free end opposite the hinge with an arcuate neck receiving opening formed integrally therein and defining opposing channels disposed on each side of the neck receiving opening;

the second section having a free end opposite the hinge, the first and second sections together being of a length such that the free end of the second section will engage an inner surface of the basin to support the tray between the recipient and the basin; and a pair of elongated supports each depending from respective ends of the opposing channels and extending toward and generally perpendicular to the hinge, the supports being of greatest height proximate to the free end of the first section and of decreasing height as they extend toward the hinge, the height and slope of the platforms being sufficient to maintain the neck receiving opening against a recipient's neck while directing run-off flow towards the second section of the rigid body during a shampooing operation substantially independent of the recipient's height.

11. The self adjusting and self securing shampoo tray of claim 10 wherein the rigid body, the hinge and the supports are integrally formed.

12. The self adjusting and self securing shampoo tray of claim 10 wherein the supports slope in a generally arcuate manner.

* * * * *